US005409882A

United States Patent [19]

Minato et al.

[11] Patent Number: 5,409,882

[45] Date of Patent: Apr. 25, 1995

[54] THERMAL TRANSFER DYE IMAGE-RECEIVING SHEET

[75] Inventors: Toshihiro Minato, Tokyo; Shigeo Hayashi, Kawasaki; Yukio Kusaka, Utsunomiya, all of Japan

[73] Assignees: New Oji Paper Co., Ltd.; Sony Corporation, both of Tokyo, Japan

[21] Appl. No.: 984,455

[22] Filed: Dec. 2, 1992

[30] Foreign Application Priority Data

Dec. 6, 1991 [JP] Japan ..... 3-323210
Nov. 12, 1992 [JP] Japan ..... 4-302458

[51] Int. Cl.[6] ..... B41M 5/035; B41M 5/38

[52] U.S. Cl. ..... 503/227; 428/195; 428/341; 428/447; 428/488.4; 428/913; 428/914

[58] Field of Search ..... 8/471; 428/195, 447, 428/913, 914, 341, 488.4; 503/227

[56] References Cited

U.S. PATENT DOCUMENTS 5,001,012 3/1991 Sarkar et al. ..... 428/447
5,260,255 11/1993 Sudo et al. ..... 503/227

OTHER PUBLICATIONS

Patent Abstracts of Japan, vol. 14, No. 388 (M-1014), 1990.

*Primary Examiner*—B. Hamilton Hess
*Attorney, Agent, or Firm*—Armstrong, Westerman, Hattori, McLeland & Naughton

[57] ABSTRACT

A thermal transfer dye image-receiving sheet resistive to fuse-adhesion of ink ribbons and to dye-adhesion at a back surface thereof, comprising a dye-receiving layer formed on a front surface of a substrate sheet and comprising a dye-receiving resin material, for example, a polyester, and a back surface coating layer formed on a back surface of the substrate sheet and comprising a release agent comprising at least one member selected from silicone block copolymer resins, silicone oils, silicone varnishes, fluorine compounds, phosphate compounds or fatty acid ester compounds.

15 Claims, 1 Drawing Sheet

THERMAL TRANSFER DYE IMAGE-RECEIVING SHEET

BACKGROUND OF THE INVENTION

1. Field of the Invention

The present invention relates to a thermal transfer dye image-receiving sheet usable for a thermal imaging printer by which sublimating dye images can be thermally transferred on the image-receiving sheet. More particularly, the present invention relates to a thermal transfer dye image receiving sheet that can be smoothly delivered through a printer without fuse-adhering to an ink ribbon even when the image-receiving sheet is fed into the printer incorrectly, and that is strongly resistant to an undesirable transfer of dye images from a dye image-receiving layer of a dye image-receiving sheet to a back surface of an adjacent dye image-receiving sheet superimposed on the above-mentioned sheet and brought into contact with the above-mentioned dye image-receiving layer.

2. Description of the Related Art

Currently there is an enormous interest in the development of new types of thermal transfer dye printers capable of printing clear full color images or pictures.

In the operation of the thermal transfer dye printers, an image-receiving sheet having a dye image-receiving layer comprising a sublimating dye-dyeable resin is superimposed on an ink ribbon having a sublimating dye layer in such a manner that the image-receiving layer of the image-receiving sheet is brought into contact with the sublimating dye layer of the ink ribbon, and the ink ribbon is locally heated imagewise by a thermal head in accordance with electric signals corresponding to the image or pictures to be printed, to thereby thermally transfer the dye images or pictures having a color density corresponding to the amount of heat applied to the ink ribbon superimposed on the image-receiving sheet through the thermal head.

To form high quality dye images by a thermal transfer operation at a high speed in a thermal image printer, an image-receiving sheet is provided with an image-receiving layer comprising, as a main component, a resin material capable of being easily dyed with a sublimating dye. Also, a back coating layer is formed on a back surface opposite to the image-receiving layer surface of the image-receiving sheet to improve travelling properties, anti-static properties and slipping properties of the image-receiving sheet.

If the image-receiving sheet is fed into the printer incorrectly, the dye layer containing a dye and a binder resin of the ink ribbon is fuse-adhered to the back surface of the image-receiving sheet and thus movement of the image-receiving sheet through the printer is impeded. To prevent the above-mentioned impediment, in the conventional image-receiving sheet, an optically or magnetically readable detection mark is provided on the back surface of tile image-receiving sheet, and when the image-receiving sheet is fed to the printer, inside out, the detection mark is detected by a sensor equipped in the printer and the detected image-receiving sheet is discharged from the printer without being printed so as to prevent fuse adhesion of the ink ribbon to the image-receiving sheet.

However, when the image-receiving sheet is used in the form of a plurality of cut sheet pieces, and the detection marks are placed in the wrong positions on the cut sheet pieces, the marks are outside of the detecting range of the sensor and thus cannot be detected. Accordingly, the detection marks must be located at predetermined positions with a margin allowance of error of 1 to 2 mm.

To provide the cut sheets each having a detection mark precisely .located at a predetermined position by cutting a continuous sheet having a plurality of detection marks located at predetermined intervals, a special precise cutter must be employed.

Further, when the conventional image-receiving sheets are superimposed on each other after a printing operation, the printed image-receiving layer of an image-receiving sheet sometimes lightly fuse-adheres to the back surface of an adjacent image-receiving sheet in direct contact with the above-mentioned image-receiving sheet, and a portion of the dye received in the image-receiving layer is transferred onto the back surface of the adjacent sheet so that the color density of the images retained in the image-receiving layer is reduced.

SUMMARY OF THE INVENTION

An object of the present invention is to provide a thermal transfer dye image-receiving sheet resistant to undesirable fuse-adhesion of a back surface thereof to an ink ribbon during a thermal image-printing operation, even when the image-receiving sheet is fed into a printer incorrectly.

Another object of the present invention is to provide a thermal transfer dye image-receiving sheet having a back surface thereof resistant to an undesirable transfer of dye images from a dye image-receiving layer of an adjacent dye image-receiving sheet brought into direct contact with the back surface.

The above-mentioned objects can be attained by the thermal transfer dye image-receiving sheet of the present invention, which comprises a substrate sheet; a dye image-receiving layer formed on a front surface of the substrate sheet and comprising, as a main component thereof, a dye-receiving resin material; and a back surface coating layer formed on a back surface of the substrate sheet, and comprising a release agent with at least one member selected from the group consisting of silicone block copolymer resins, silicone oils, silicone rubbers, fluorine compounds, phosphate ester compounds, and fatty acid ester compounds.

In the thermal transfer dye image-receiving sheet of the present invention, it is essential that a back surface coating layer comprising a release agent is formed on a surface of a substrate sheet opposite the other surface thereof, on which a dye image-receiving layer is formed.

The release agent-containing a back surface coating layer effectively prevents undesirable fuse-adhesion of the dye image-receiving sheet to an ink ribbon during a thermal printing operation, even when the dye image-receiving sheet is fed into a printer incorrectly.

Also, the release agent-containing a back surface coating layer effectively/prevents undesirable adhesion of dye image-receiving sheets superimposed on each other to one another and an undesirable dye-transfer from a printed dye image-receiving layer to a back surface layer of an adjacent dye image-receiving sheet brought into direct contact with the printed dye image-receiving layer, and thus the color density of the printed dye images is not reduced.

DESCRIPTION OF THE PREFERRED EMBODIMENTS

Figure 1:
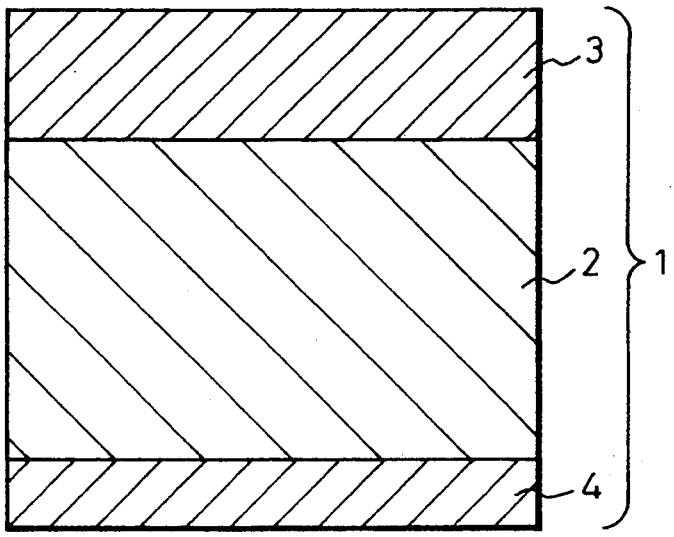
FIG. 1 is an explanatory cross-sectional profile of an embodiment of the thermal transfer dye image-receiving sheet of the present invention.

In FIG. 1, the image-receiving sheet 1 of the present invention is composed of a substrate sheet 2, a dye image-receiving layer 3 formed on a front surface of the substrate sheet 2 for forming print images thereon by receiving a dye, and a back surface coating layer 4 formed on a back surface of the substrate sheet 1; namely a surface opposite the surface on which the dye image-receiving layer is formed.

In the thermal transfer dye image-receiving sheet, the substrate sheet consists of a member selected from the group consisting of coated paper sheets, art paper sheets, non-coated fine paper sheets, laminate paper sheets in which a resin layer, for example, a polyethylene resin layer, is coated on a front and/or back surface of a base paper sheet, synthetic resin films, for example, polyester, polyamide (nylon), polystyrene and polypropylene films, synthetic paper sheets, for example, multi-layered, bi-axially oriented paper-like sheets comprising, as a main component, a mixture of a polyolefin resin with an inorganic pigment and having a plurality of voids, and composite sheets comprising two or more of the above-mentioned sheets laminated on each other.

Preferably, the substrate sheet has a thickness of from 50 to 300 μm, and more preferably 100 to 200 μm.

In the image-receiving sheet of the present invention, the dye image-receiving layer arranged on a surface of the substrate sheet comprises, as a main component, a dye-receiving resin material that is capable of being dyed with a sublimating dye transferred from an ink ribbon. The dye-receiving resin material comprises at least one member selected from the group consisting of, for example, polyester resins, for example, polyethylene terephthalate and polybutylene terephthalate resins, polyacrylate resins, styrene-acrylate copolymer resins, polycarbonate resins, vinyl chloride copolymer resins, for example, vinyl chloride-vinyl acetate copolymers, and vinyl chloride-vinyl propionate copolymers, and cellulose derivative resins, for example, cellulose acetate.

The dye image-receiving layer preferably has a thickness of from 1 to 10 μm, and more preferably from 2 to 7 μm. When the thickness is less than 1 μm, the resultant printed dye images have an unsatisfactorily low color density and the resultant dye image-receiving layer exhibits a reduced sensitivity, or the resultant print surface exhibits reduced glossiness. Also, when the thickness is more than 10 μm, the resultant dye image-receiving layer has reduced mechanical strength.

Preferably, the dye image-receiving layer of the present invention contains a resin cross-linking agent, lubricant, release agent and/or pigment for the purpose of preventing fuse-adhesion to an ink ribbon during a printing operation. Also, optionally, the dye image-receiving layer is further added with another additive, for example, a coloring pigment, fluorescent dye, coloring dye, ultraviolet ray absorbent and antioxidant.

The image-receiving sheet of the present invention is provided with a back surface coating layer formed on a back surface of the substrate sheet; namely a surface opposite the surface on which the dye image-receiving layer is formed.

The back surface coating layer comprises a release agent. As the release agent, silicone block copolymer resins, silicone oils, silicone varnishes, fluorine compounds, phosphate ester compounds, and fatty acid ester compounds are beneficially employed. These agents can be used alone or as a mixture of two or more thereof.

The silicone oils and varnishes usable as the release agent are preferably selected from dimethyl silicone oils, methylphenyl silicone oiles, carbinol-modified silicone oils, epoxy-modified silicone oils, carboxy-modified silicone oils, amino-modified silicone oils, polyether-modified silicone oils, silicone-polyester varnishes, silicone-acrylic varnishes, and silicone-urethane varnishes. Generally, when used as a release agent, usual silicone compounds must be cured to completely prevent fuse-adhesion of the back surface coating layer to the ink ribbon. This curing step requires a certain amount of time to complete the curing and the resultant back surface coating layer is sometimes stained by a non-cured silicone compound. Also, a product of a graft polymerization of a siloxane group-containing polymer with another polymer: has the disadvantage that the graft polymerization product exhibits a lower curing property for the prevention of fuse-adhesion than that of other block-polymerization products.

Accordingly, as a release agent usable for the present invention, silicone block copolymer (A-B type) resins comprising siloxane group-containing polymeric segment (A) with another polymer segment B is preferably employed. The silicone block copolymer as mentioned above is selected from, for example, silicone-acryl block copolymer resins, silicone-epoxy block copolymer resins, silicone-polyester block copolymer resins, silicone-alkyd block copolymer resins, silicone-phenol-formaldehyde resin block copolymer resins, silicone-urethane block copolymer resins, and silicone-melamine-formaldehyde resin block copolymer resins.

The fluorine compounds usable as a release agent are preferably selected from the group consisting of fluorine-containing acrylic resins, fluorine-containing epoxy resins, fluorine-containing polyimide resins and fluorine-containing surface active compounds.

The phosphate ester compounds usable as a release agent are preferably selected from the group consisting of polyoxyalkylene phosphates and salts thereof.

The fatty acid ester compounds usable as a release agent are preferably selected from the group consisting of ethyleneglycol-fatty acid esters, sorbitol-fatty acid esters, and polyoxyethylene-fatty acid esters.

The back surface coating layer of the present invention optionally comprises a resinous material as a binder for the release agent. The resinous material is effective not only as a binder but also for the control of a frictional coefficient of the image-receiving sheet to smoothly travel through a printer and to protect a dye image-receiving layer from damages thereof.

The resinous material preferably comprises at least one member selected from polyacrylic resins, epoxy resins, polyester resins, phenol-formaldehyde resins, alkyd resins, polyurethane resins, melamine-formaldehyde resins, and cross-linking reaction products of the above-mentioned resins. Preferably, the resinous material has a minimum film-forming temperature (MFT) of 50° C. or more or a glass transition temperature (Tg) of 20° C. or more.

In the formation of the back surface coating layer, the release agent is physically mixed with the binder resin material and then the mixture is applied to a back surface of a substrate sheet. Preferably, a resinous material functioning both as the release agent and the binder, for example, a silicone block copolymer resin, is employed to form the back surface coating layer.

In the back surface coating layer of the image-receiving sheet of the present invention, preferably an electroconductive agent is contained to prevent a charge in static electricity thereon. In this case, it is preferable that the surface resistivity of the back surface coating layer be controlled to a level of $1\times10^9$ Ω.cm or less.

The electroconductive agent preferably comprises at least one member selected from the group consisting of cationic monomeric component-containing acrylic polymers, cation-modified acrylamide resins and cation-modified starches.

In the present invention, the components of the back surface coating layer are not restricted to a specific mixing ratio or amount. Nevertheless, preferably, the back surface coating layer comprises 100 parts by weight of a binder resin material, 3 to 100 parts by weight of a release agent and 30 to 150 parts by weight of an electroconductive agent.

When the amount of the release agent is less than 3 parts by weight, the resultant back surface coating layer sometimes exhibits an unsatisfactory resistance to fuse-adhesion to an ink ribbon.

Even if the amount of the release agent is more than 100 parts by weight, further enhancement of the fuse adhesion-preventing effect is sometimes not expected and is not economical.

When the amount of the electroconductive agent is less than 30 parts by weight, the antistatic effect on the back surface coating layer is sometimes unsatisfactory.

Even if the amount of the electroconductive agent is more than 150 parts by weight, further enhancement in the antistatic effect is sometimes not expected and is not economical.

Usually, the back surface coating layer is formed with a dry weight of 0.3 to 1.5 g/m$^2$. If the dry weight is less than 0.3 g/m$^2$, the resultant back surface coating layer sometimes damages the dye image-receiving layer when they come into contact with each other. Even if the dry weight is increased to more than 1.5 g/m$^2$, additional advantages are not obtained and it is wasteful.

In the image-receiving sheet of the present invention, an intermediate layer is optionally formed between the substrate sheet and the dye image-receiving layer to impart an antistatic property and a cushion effect upon the dye image-receiving layer.

The dye image-receiving layer, the back surface coating layer and other layers of the image-receiving sheet of the present invention can be formed by coating a coating liquid containing necessary components by using a coater, for example, bar coater, comma coater, blade coater, gravua coater, airknife coater and gateroll coater, and drying the coated liquid layer.

EXAMPLES

The present invention will be further explained with reference to the following examples.

Example 1

A substrate sheet was prepared by bonding a bi-axially oriented polyolefin film (available under the trademark of Yupo FPG50 from OJI YUKAGOSEISHI CO.) containing an inorganic pigment and having a thickness of 50 μm to a front surface of a polyethylene terephthalate (PET) film having a thickness of 50 μm through a polyester bonding agent by a dry laminate method, and then bonding a bi-axially oriented polyolefin film (available under the trademark of Yupo FPG60, from OJI YUKAGOSEISHI CO.) having a thickness of 60 μm to a back surface of the polyester (PET) film in the same manner as mentioned above.

A dye image-receiving layer was formed on the front surface (Yupo FPG50 film side) of the substrate sheet by coating a coating liquid 1 having the following composition by a die coating method.

| Coating liquid 1 | |
|---|---|
| Component | Part by weight |
| Saturated polyester resin(*)1 | 100 |
| Silicone resin(*)2 | 5 |
| Isocyanate curing agent(*)3 | 5 |
| Toluene/methylethylketone (5/1) mixed solvent | 620 |

Note:
(*)1Available under the trademark of Vylon 200 from Toyobo K.K.
(*)2Available under the trademark of Silicone SH3746, from Toray Dow Corning Silicone Co.
(*)3Available under the trademark of Colonate L, from Nihon Polyurethane Co.

The resultant dye image-receiving layer had a dry weight of 5 g/m$^2$.

The back surface (Yupo FPG60 film side) of the substrate sheet was coated with a back surface coating layer with a dry weight of 0.5 g/m$^2$ by coating a coating liquid 2 having the following compositions using a die coating method, and drying the coated liquid layer.

| Coating liquid 2 | |
|---|---|
| Component | Part by weight |
| Silicone-acryl block copolymer(*)4 | 100 |
| Electroconductive agent(*)5 | 50 |
| Denatured ethyl alcohol | 1350 |

Note:
(*)4Available under the trademark of Modiper FS700, from Nihon Yushi K.K.
(*)5Available under the trademark of Saftmer ST1000, from Mitsubishi Yuka K.K.

An image-receiving sheet was obtained.

The image-receiving sheet was fed to a sublimating dye color video printer (Trademark: VY-P1, Hitachi Seisakusho), incorrectly so that the back surface of the image-receiving sheet is brought into contact with an ink ribbon, so as to evaluate the resistance of the back surface coating layer to fuse-adhere to the ink ribbon, and the forwarding property of the image-receiving sheet through the printer.

The color density of the dye images printed on the back surface coating layer and the surface resistivity of the back surface coating layer were also evaluated.

The above-mentioned evaluation was carried out in the following manner.

| Class | Feature |
|---|---|
| | (1) Fuse-adhesion to ink ribbon |
| 3 | No binder blocks were transferred, and sheet passed through printer smoothly. |
| 2 | Binder blocks were transferred, and sheet passed through printer smoothly. |
| 1 | Binder blocks were transferred and sheet could not pass through printer smoothly. |
| | (2) Travelling property of sheet |
| | 20 pieces of image-receiving sheets were fed |

-continued

| Class | Feature |
|---|---|
| | into the printer. |
| 3 | All 20 sheets could pass through printer smoothly. |
| 2 | 1 to 5 sheets could not be fed to or delivered from printer smoothly. |
| 1 | 6 or more sheets could not be fed to or delivered from printer smoothly. |

(3) Color Density of Dye Images Transferred to Back Surface Coating Layer

An image-receiving sheet was subjected to a solid printing to form a close black image on a dye image-receiving layer of the sheet.

Another image-receiving sheet is superimposed on the printed sheet in such a manner that a back surface coating layer of the other sheet comes into contact with the solid printed dye image-receiving layer of the printed sheet. The superimposed sheets were pressed under a load of 40 g/cm$^2$ at a temperature of 60° C. for 10 days. The other sheet was then removed from the printed sheet and the color density of the dye image transferred to the back surface coating layer of the other sheet was measured using a Macbeth Color Density Tester (Trademark: RD-914, made by Kollmorgen Corp.).

(4) Surface Resistivity

An image-receiving sheet was conditioned at a temperature of 20° C. at a relative humidity of 60% for 24 hours. The surface resistivity of the back surface coating layer of the conditioned sheet was then measured using a surface resistivity tester (trademark: High Lester HT-210, made by Mitsubishi Yuka K.K.)

The test results are shown in Table 1.

Example 2

A thermal transfer dye image-receiving sheet was produced using the same procedures as in Example 1, with the following exceptions.

The back surface coating layer was formed from a coating liquid 3 having the following composition.

| Coating liquid 3 | |
|---|---|
| Component | Part by weight |
| Acrylic ester copolymer(*)6 | 100 |
| Epoxy resin(*)7 | 5 |
| Silicone oil(*)8 | 3 |
| Electroconductive agent(*)5 | 50 |
| Denatured ethyl alcohol | 1420 |

Note:
(*)6Available under the trademark of Primal WL-81, from Rhom & Haas
(*)7Available under the trademark of Epocoat DX-255, from Schell Kagaku K.K.
(*)8Available under the trademark of Silicone oil YF3818, from Toshiba Silicone K.K.

The test results are shown in Table 1.

Example 3

A thermal transfer dye image-receiving sheet was produced using the same procedures as in Example 1, with the following exceptions.

The back surface coating layer was formed from a coating liquid 4 having the following composition.

| Coating liquid 4 | |
|---|---|
| Component | Part by weight |
| Fluorine-containing acrylic resin(*)9 | 100 |
| Electroconductive agent(*)5 | 50 |
| Denatured ethyl alcohol | 1350 |

Note:(*)9Available under the trademark of Modiper F250, from Nihon Yushi K.K.

The test results are shown in Table 1.

Example 4

A thermal transfer dye image-receiving sheet was produced using the same procedures as in Example 1, with the following exceptions.

The back surface coating layer was formed from a coating liquid 5 having the following composition.

| Coating liquid 5 | |
|---|---|
| Component | Part by weight |
| Acrylic ester copolymer(*)6 | 100 |
| Epoxy resin (*)7 | 5 |
| Fluorine-containing surface active agent(*)10 | 50 |
| Electroconductive agent(*)5 | 50 |
| Denatured ethyl alcohol | 1845 |

Note:
(*)10Available under the trademark of Megafac F-815, from Dainihon Ink Chemical Co.

The test results are shown in Table 1.

Example 5

A thermal transfer dye image-receiving sheet was produced using the same procedures as in Example 1, with the following exceptions.

The back surface coating layer was formed from a coating liquid 6 having the following composition.

| Coating liquid 6 | |
|---|---|
| Component | Part by weight |
| Acrylic ester copolymer(*)6 | 100 |
| Epoxy resin(*)7 | 5 |
| Higher fatty acid ester(*)11 | 5 |
| Electroconductive agent(*)5 | 30 |
| Denatured ethyl alcohol | 1260 |

Note:
(*)11Available under the trademark of Butyl Stearate, from Nihon Yushi K.K.

The test results are shown in Table 1.

Example 6

A thermal transfer dye image-receiving sheet was produced using the same procedures as in Example 1, with the following exceptions.

The back surface coating layer was formed from a coating liquid 7 having the following composition.

| Coating liquid 7 | |
|---|---|
| Component | Part by weight |
| Acrylic ester copolymer(*)6 | 100 |
| Epoxy resin(*)7 | 5 |
| Phosphate ester(*)12 | 5 |
| Electroconductive agent(*)5 | 30 |
| Denatured ethyl alcohol | 1260 |

Note:
(*)12Available under the trademark of Efcol 301, from Matsumoto Yushi K.K.

The test results are shown in Table 1.

Comparative Example 1

A thermal transfer dye image-receiving sheet was produced using the same procedures as in Example 1, with the following exceptions.

The back surface coating layer was formed from a coating liquid 8 having the following composition.

| Coating liquid 8 | |
|---|---|
| Component | Part by weight |
| Acrylic ester copolymer(*)6 | 100 |
| Epoxy resin(*)6 | 5 |
| Denatured ethyl alcohol | 945 |

The test results are shown in Table 1.

Comparative Example 2

A thermal transfer dye image-receiving sheet was produced using the same procedures as in Example 1, with the following exceptions.

The back surface coating layer was formed from a coating liquid 9 having the following composition.

| Coating liquid 9 | |
|---|---|
| Component | Part by weight |
| Acrylic ester copolymer(*)6 | 100 |
| Epoxy resin(*)7 | 5 |
| Silicone oil(*)8 | 2 |
| Electroconductive agent(*)5 | 50 |
| Denatured ethyl alcohol | 1410 |

The test results are shown in Table 1.

Comparative Example 3

A thermal transfer dye image-receiving sheet was produced using the same procedures as in Example 1, with the following exceptions.

The back surface coating layer was formed from a coating liquid 10 having the following composition.

| Coating liquid 10 | |
|---|---|
| Component | Part by weight |
| Acrylic ester copolymer(*)6 | 100 |
| Epoxy resin(*)7 | 5 |
| Electroconductive agent(*)5 | 50 |
| Denatured ethyl alcohol | 1400 |

The test results are shown in Table 1.

Comparative Example 4

A thermal transfer dye image-receiving sheet was produced using the same procedures as in Example 1, with the following exceptions.

The back surface coating layer was formed from a coating liquid 11 having the following composition.

| Coating liquid 11 | |
|---|---|
| Component | Part by weight |
| Acrylic ester copolymer(*)6 | 100 |
| Epoxy resin(*)7 | 5 |
| Silicone oil(*)8 | 3 |
| Electroconductive agent(*)5 | 20 |
| Denatured ethyl alcohol | 1150 |

The test results are shown in Table 1.

Comparative Example 5

A thermal transfer dye image-receiving sheet was produced using the same procedures as in Example 1, with the following exceptions.

The back surface coating layer was formed from a coating liquid 12 having the following composition.

| Coating liquid 12 | |
|---|---|
| Component | Part by weight |
| Acryl-silicone graft copolymer(*)13 | 100 |
| Electroconductive agent(*)5 | 50 |
| Denatured ethyl alcohol | 1350 |

Note:
(*)13Available under the trademark of Saimac US-120, from Toa Gosei-Kagaku Kogyo K.K.

The test results are shown in Table 1.

TABLE 1

Performances of image-receiving sheets of Examples 1 to 6 and Comparative Examples 1 to 5

| Example No. | Item: Resistance to fuse-adhesion | Sheet forwarding property | Color density of transferred dye image | Surface resistivity (Ω · cm) |
|---|---|---|---|---|
| Example | | | | |
| 1 | 3 | 3 | 0.14 | $5.0 \times 10^7$ |
| 2 | 3 | 3 | 0.18 | $4.8 \times 10^8$ |
| 3 | 3 | 3 | 0.12 | $3.2 \times 10^8$ |
| 4 | 3 | 3 | 0.15 | $5.0 \times 10^8$ |
| 5 | 3 | 3 | 0.14 | $4.8 \times 10^8$ |
| 6 | 3 | 3 | 0.13 | $2.8 \times 10^8$ |
| Comparative Example | | | | |
| 1 | 1 | 1 | 0.58 | $6.2 \times 10^{12}$ |
| 2 | 2 | 3 | 0.35 | $4.9 \times 10^8$ |
| 3 | 1 | 3 | 0.62 | $4.8 \times 10^8$ |
| 4 | 3 | 2 | 0.18 | $5.0 \times 10^9$ |
| 5 | 1 | 3 | 0.14 | $3.8 \times 10^9$ |

Table 1 clearly shows that the back surface coatings layer of the image-receiving sheet of the present invention is highly resistant to fuse-adhesion to a ink ribbon even when the image-receiving sheet is fed to a printer incorrectly, and thus can be smoothly delivered from the printer. Therefore, the image-receiving sheet can be employed without experiencing problems in sheet feeding and delivery, even when a detection mark is not provided on the back surface coating layer.

Also, Table 1 shows that the back surface coating layer exhibits a high resistance to the transfer of a dye from dye images formed on a dye image-receiving layer of another sheet.

We claim:

1. A thermal transfer dye image-receiving sheet comprising:

a substrate sheet;

a dye image-receiving layer formed on a formed on a front surface of the substrate sheet and comprising, as a main component thereof, a dye-receiving resin material; and a back surface coating layer formed on a back surface of the substrate sheet and comprising a release agent comprising at least one silicone block copolymer resin selected from the group consisting of silicone-acryl block copolymer resins, silicone-epoxy block copolymer resins, silicone-polyester block copolymer resins, silicone-alkyd block copolymer resins, silicone-phenol-formaldehyde resin block copolymer resins, silicone-urethane block copolymer resins, and silicone-melamine-formaldehyde resin block copolymer resins.

2. The thermal transfer dye image-receiving sheet as claimed in claim 1, wherein the back surface coating layer further comprises a binder resin material.

3. The thermal transfer image-receiving sheet as claimed in claim 2, wherein the binder resin material comprises at least one member selected from the group consisting of polyacrylic resins, epoxy resins, polyester resins phenol-formaldehyde resins, alkyd resins, polyurethane resins, melamine-formaldehyde resins, and cross-linking reaction products of the above-mentioned resins.

4. The thermal transfer dye image-receiving sheet as claimed in claim 2, wherein the binder resin material has a minimum film-forming temperature (MFT) of 50° C. or more.

5. The thermal transfer dye image-receiving sheet as claimed in claim 2, wherein the binder resin material has a glass transition temperature (Tg) of 20° C. or more.

6. The thermal transfer image-receiving sheet as claimed in claim 1, wherein the back surface coating layer further comprises an electroconductive agent.

7. The thermal transfer dye image-receiving sheet as claimed in claim 6 wherein the electroconductive agent comprises at least one member selected from the group consisting of cationic monomeric component-containing acrylic polymers, cation-modified acrylic amide polymers and cation-modified starches.

8. The thermal transfer dye image-receiving sheet as claimed in claim 6, wherein the electroconductive agent-containing back surface layer has a surface resistivity of $1\times10^9\ \Omega$ un or less.

9. The thermal transfer dye image-receiving sheet as claimed in claim 6, wherein the back surface coating layer comprises 100 parts by weight of a binder resin material, 3 to 100 parts by weight of a release agent and 30 to 150 parts by weight of an electroconductive agent.

10. The thermal transfer dye image-receiving sheet as claimed in claim 1, wherein the back surface coating layer is present in an amount of from 0.3 to 1.5 $g/m^2$.

11. The thermal transfer dye image-receiving sheet as claimed in claim 1, wherein the dye-receiving resin material comprises at least one member selected from the group consisting of polyester resins, polycarbonate resins, vinyl chloride copolymer resins and cellulose derivative resins.

12. The thermal transfer dye image-receiving sheet as claimed in claim 1, wherein the dye-receiving layer has a thickness of 1 to 10 $\mu$m.

13. The thermal transfer dye image-receiving sheet as claimed in claim 1, wherein the substrate sheet comprises a member selected from the group consisting of paper sheets, synthetic resin films, and synthetic paper sheets.

14. The thermal transfer dye image-receiving sheet as claimed in claim 1, wherein the substrate sheet has a thickness of 50 to 300 $\mu$m.

15. A thermal transfer dye image-receiving sheet comprising:

a substrate sheet;

a dye image-receiving layer formed on a front surface of the substrate sheet and ,comprising, as a main component thereof, a dye-receiving resin material; and a back surface coating layer formed on a back surface of the substrate sheet and comprising a release agent comprising at least one silicone block copolymer resin comprising siloxane group-containing polymeric segments and other polymeric segments.

* * * * *